US009067425B2

(12) United States Patent
Blowfield et al.

(10) Patent No.: US 9,067,425 B2
(45) Date of Patent: Jun. 30, 2015

(54) FLUID CARTRIDGE FOR AN INKJET PRINTER

(71) Applicant: VIDEOJET TECHNOLOGIES INC., Wood Dale, IL (US)

(72) Inventors: Philip Blowfield, Kettering (GB); Matthew Tomlin, Cambridge (GB); Carl Mann, St. Ives (GB); Ian Fost, Cambs (GB); Jerzy Zaba, Histon (GB)

(73) Assignee: VIDEOJET TECHNOLOGIES INC., Wood Dale, IL (US)

( * ) Notice: Subject to any disclaimer, the term of this patent is extended or adjusted under 35 U.S.C. 154(b) by 0 days.

(21) Appl. No.: 14/103,187

(22) Filed: Dec. 11, 2013

(65) Prior Publication Data

US 2014/0362147 A1 Dec. 11, 2014

Related U.S. Application Data

(63) Continuation-in-part of application No. 12/680,919, filed as application No. PCT/GB2008/003403 on Oct. 9, 2008, application No. 14/103,187, which is a continuation-in-part of application No. 13/679,177, filed on Nov. 16, 2012, now Pat. No. 8,632,172, which is a continuation of application No. 12/680,926, filed on Mar. 31, 2010, now Pat. No. 8,366,252.

(30) Foreign Application Priority Data

Oct. 12, 2007 (GB) ..... 0720139.5
Oct. 12, 2007 (GB) ..... 0720288.0

(51) Int. Cl.
*B41J 2/17* (2006.01)
*B41J 2/175* (2006.01)

(52) U.S. Cl.
CPC ..... *B41J 2/17526* (2013.01); *B41J 2/17553* (2013.01)

(58) Field of Classification Search
USPC ..... 347/7, 84–86
See application file for complete search history.

(56) References Cited

U.S. PATENT DOCUMENTS 4,998,116 A 3/1991 Regnault
5,359,353 A 10/1994 Hunt
6,074,050 A * 6/2000 Perez et al. ..... 347/86

(Continued)

FOREIGN PATENT DOCUMENTS

JP A-2001-1541 1/2001
JP A-2002-53114 2/2002
JP A-2005-199448 7/2005

*Primary Examiner* — Jason Uhlenhake
(74) *Attorney, Agent, or Firm* — Joseph A. Yosick

(57) ABSTRACT

A fluid cartridge for an inkjet printer includes an inner reservoir containing a printing fluid. The reservoir includes walls enclosing an internal space having a variable volume for storage of the printing fluid and a port for dispensing the printing liquid. The reservoir includes a rigid framework and one or more elastically deformable sections. The cartridge further includes an outlet for connection to the printer, an outer housing in which the reservoir is housed, an electronic storage device configured to store data relating to the contents of the cartridge, and at least one electrical contact associated with the electronic storage device and provided on a substrate. The reservoir provides a reduction in pressure of the internal space whereby the equilibrium pressure difference between the internal space and the surrounding atmosphere increases substantially monotonically in magnitude as liquid is dispensed.

20 Claims, 7 Drawing Sheets

(56) References Cited

U.S. PATENT DOCUMENTS

| | | | | |
|---|---|---|---|---|
| 6,170,937 | B1 | 1/2001 | Childers | |
| 6,585,359 | B1 * | 7/2003 | Gasvoda et al. | 347/86 |
| 6,644,794 | B1 | 11/2003 | Wilson | |
| 2002/0027581 | A1 * | 3/2002 | Higuma et al. | 347/86 |
| 2003/0184604 | A1 * | 10/2003 | Thielman et al. | 347/1 |
| 2004/0135854 | A1 | 7/2004 | Kuwabara | |
| 2007/0145059 | A1 | 6/2007 | Ogura | |
| 2008/0079790 | A1 * | 4/2008 | Kachi | 347/87 |

* cited by examiner

FLUID CARTRIDGE FOR AN INKJET PRINTER

CROSS-REFERENCE TO RELATED APPLICATIONS

This application is a continuation-in-part of U.S. application Ser. No. 12/680,919 filed Mar. 31, 2010, which in turn claims priority under 35 U.S.C. §371 from PCT Application No. PCT/GB2008/003403, filed in English on Oct. 9, 2008, which claims the benefit of Great Britain Application Serial No. 0720288.0 filed on Oct. 12, 2007; and is also a continuation-in-part of U.S. application Ser. No. 13/679,177 filed Nov. 16, 2012, which is a continuation of U.S. application Ser. No. 12/680,926, filed on Mar. 31, 2010, which claims priority under 35 U.S.C. §371 from PCT Application No. PCT/GB2008/003410, filed in English on Oct. 9, 2008, which claims the benefit of Great Britain Application Serial No. 0720139.5 filed on Oct. 12, 2007, the contents of all of which are incorporated herein by reference in their entireties.

BACKGROUND

The present invention relates to ink jet printing and more particularly to a fluid supply cartridge for an ink jet printer such as a continuous ink jet printer.

In ink jet printing systems the print is made up of individual droplets of ink generated at a nozzle and propelled towards a substrate. There are two principal systems: drop on demand where ink droplets for printing are generated as and when required; and continuous ink jet printing in which droplets are continuously produced and only selected ones are directed towards the substrate, the others being recirculated to an ink supply.

Continuous ink jet printers supply pressurized ink to a print head drop generator where a continuous stream of ink emanating from a nozzle is broken up into individual regular drops by, for example, an oscillating piezoelectric element. The drops are directed past a charge electrode where they are selectively and separately given a predetermined charge before passing through a transverse electric field provided across a pair of deflection plates. Each charged drop is deflected by the field by an amount that is dependent on its charge magnitude before impinging on the substrate whereas the uncharged drops proceed without deflection and are collected at a gutter from where they are recirculated to the ink supply for reuse. The charged drops bypass the gutter and hit the substrate at a position determined by the charge on the drop and the position of the substrate relative to the print head. Typically the substrate is moved relative to the print head in one direction and the drops are deflected in a direction generally perpendicular thereto, although the deflection plates may be oriented at an inclination to the perpendicular to compensate for the speed of the substrate (the movement of the substrate relative to the print head between drops arriving means that a line of drops would otherwise not quite extend perpendicularly to the direction of movement of the substrate).

In continuous ink jet printing a character is printed from a matrix comprising a regular array of potential drop positions. Each matrix comprises a plurality of columns (strokes), each being defined by a line comprising a plurality of potential drop positions (e.g. seven) determined by the charge applied to the drops. Thus each usable drop is charged according to its intended position in the stroke. If a particular drop is not to be used then the drop is not charged and it is captured at the gutter for recirculation. This cycle repeats for all strokes in a matrix and then starts again for the next character matrix.

Ink is delivered under pressure to the print head by an ink supply system that is generally housed within a sealed compartment of a cabinet that includes a separate compartment for control circuitry and a user interface panel. The system includes a main pump that draws the ink from a reservoir or tank via a filter and delivers it under pressure to the print head. As ink is consumed the reservoir is refilled as necessary from a replaceable ink cartridge that is releasably connected to the reservoir by a supply conduit. The ink is fed from the reservoir via a flexible delivery conduit to the print head. The unused ink drops captured by the gutter are recirculated to the reservoir via a return conduit by a pump. The flow of ink in each of the conduits is generally controlled by solenoid valves and/or other like components.

As the ink circulates through the system, there is a tendency for it to thicken as a result of solvent evaporation, particularly in relation to the recirculated ink that has been exposed to air in its passage between the nozzle and the gutter. To compensate for this, "make-up" solvent is added to the ink as required from a replaceable ink cartridge so as to maintain the ink viscosity within desired limits. This solvent may also be used for flushing components of the print head, such as the nozzle and the gutter, in a cleaning cycle.

The ink and solvent cartridges are filled with a predetermined quantity of fluid and generally releasably connected to the reservoir of the ink supply system by a flexible supply hose or tube so that the reservoir can be intermittently topped-up by drawing ink and/or solvent from the cartridges as required. To ensure the cartridges are brought into correct registration with the supply hoses they are typically connected to the ink supply system via a docking station comprising a cartridge holder. When the cartridges are correctly docked fluid communication with an outlet port of the cartridge is ensured.

It is important from the manufacturer's perspective that the ink jet printer is consumes only ink (or solvent) of the correct type and quality. If a cartridge containing the wrong ink is used the printing quality can be compromised and, in extreme cases, printer failure may be caused. It has thus become the convention to provide the cartridge with an externally machine readable label (e.g. a bar code) carrying information regarding the fluid contained within the cartridge. The label is swiped past a reader associated with the control system of the printer before the cartridge is installed and only when the control system of the printer has read the information on the label and verified that the ink is suitable for operation with the printer does it allow ink or solvent to be drawn from the cartridge.

BRIEF SUMMARY

The present disclosure provides a fluid cartridge for an ink jet printer.

In one aspect, a fluid cartridge for an inkjet printer includes an inner reservoir containing a printing fluid. The reservoir includes walls enclosing an internal space having a variable volume for storage of the printing fluid and a port for dispensing the printing liquid. The reservoir includes a rigid framework and one or more elastically deformable sections. The cartridge further includes an outlet for connection to the printer, an outer housing in which the reservoir is housed, an electronic storage device configured to store data relating to the contents of the cartridge, and at least one electrical contact associated with the electronic storage device and provided on a substrate. The reservoir provides a reduction in pressure of the internal space whereby the equilibrium pressure difference between the internal space and the surrounding atmosphere increases substantially monotonically in magnitude as liquid is dispensed. The port is adapted to allow liquid to be dispensed when a withdrawal pressure at the exterior of the port is less than the equilibrium pressure of the internal space. The port is adapted to prevent air from entering the internal space from outside the reservoir as liquid is dispensed. The container is for storing and dispensing ink or solvent for use with a continuous inkjet printer.

According to another aspect of the present invention there is provided a fluid cartridge for an ink jet printer, the cartridge comprising: an inner collapsible container for containing a printing fluid, the container having an outlet for connection to the printer; an outer housing in which the container is housed; an electronic storage device configured to store data relating to the contents of the cartridge; at least one electrical contact associated with the electronic storage device; the housing having a front wall with a first aperture for the outlet, the at least one electrical contact being disposed at the front wall.

The expression "being disposed at the front wall" is intended to include at least the possibility of the at least one electrical contact being mounted in, on or behind the front wall, providing it is accessible for connection to another contact provided on the printer. For example, the front wall may have a second aperture that provides access to the at least one electrical contact and the at least one electrical contact may be provided in the housing adjacent to the second aperture.

The fluid cartridge may be for ink or solvent or other such fluids used in the printing process.

The arrangement is such that when the cartridge is installed in a cartridge receiving portion of the printer the outlet is in fluid communication with an ink supply system of the printer and the at least one electrical contact is connected to at least one corresponding contact at the printer.

The first aperture may be disposed below the second aperture in the front wall.

The electrical storage device may be supported on the substrate which may be disposed between the housing and the inner container.

The substrate may be fixed relative to the outlet, perhaps by a holder defined on the inside of the housing which may take any suitable form including a pocket. The holder may comprise at least one fixing element that may have slots for supporting edges of the substrate.

The substrate may be mounted on the container directly or indirectly. It may be supported by an outer surface of the outlet. For example, the outlet may have a neck that supports the substrate. The edges of the substrate that define the aperture may be engaged with the outlet.

The substrate may be rigid or may be flexible. It may be in the form of a film, a label or the like or a card.

The container may have a rigid supporting surface adjacent to the substrate which may be provided by a wall having a thickness greater than that of the rest of the container wall.

A locking element may be provided for locking engagement with the substrate and this may be provided on the housing. The locking element may take any suitable form including, for example, a tongue with a terminal engaging formation such as a tip, rib or lip or the like for engagement in a slot or recess in the substrate.

The housing may comprise at least two separable portions, that when separated reveal the inner container. The housing may have at least one locating element for engagement with at least one complementary element on a cartridge holder. The at least one locating element can take any suitable form but may comprises a key for engagement with a slot in a cartridge holder or vice versa. The at least one locating element may be a recess for engagement with a protrusion on the holder.

The housing may have rigid side walls and at least one slit provided immediately adjacent corner portions of the side walls so that the corner portions can flex inwardly towards the container. At least one locating element may be defined on a surface of at least one of the corner portions, the at least one locating element being for engagement with a complementary element on a cartridge holder. The at least one locating element may be a rib or a recess or the like.

According to a further aspect of the present invention there may be provided an ink jet printer comprising a print head for generating ink drops for printing on a substrate, an ink supply system for supply ink to the print head, a fluid cartridge as defined above and a fluid cartridge receiving portion arranged to receive the fluid cartridge and to provide fluid communication between the cartridge outlet and the ink supply system, the fluid cartridge receiving portion having at least one electrical contact arranged for electrical contact with the at least one electrical contact on the cartridge when the cartridge is received.

The printer may be of the continuous type in which there is provided a catcher at the print head for receiving unused drops of ink generated and an ink return path for returning ink to the ink supply system.

According to a yet further aspect of the present invention there is provided fluid cartridge for an ink jet printer, the cartridge comprising: an inner collapsible container for containing a printing fluid, the container having an outlet for connection to the printer; an outer housing in which the container is housed; an electronic storage device configured to store data relating to the contents of the cartridge; at least one electrical contact associated with the electronic storage device and provided on a substrate; the substrate being fixed to the outlet.

The fixed relationship ensures that the outlet and the at least one electrical contact are in the correct positions for communication with elements on the printer, the outlet being intended to provide fluid communication with an ink supply system of the printer and the at least one electrical contact being for electrical connection to a corresponding contact on the printer side.

The substrate is fixed such that it does not move during collapse of the inner container, thereby ensuring electrical contact is maintained during use.

The substrate may be fixed to the outlet, in particular, it may be mounted on the outlet. For example, the substrate may have an aperture that receives the outlet whereby an edge of the substrate that defines the aperture is engaged with a surface of the outlet.

The electronic storage device may be mounted on the substrate or may be separately disposed but connected to the at least one electrical contact.

The outlet may comprise a rigid conduit extending from a wall of the container, the substrate being supported on the conduit and perhaps on a neck of the conduit. The outlet may be sealed by a penetrable sealing member, such as a septum seal that is penetrable by a needle connector.

According to yet a further aspect of the invention there is provided a fluid cartridge for an ink jet printer, the cartridge comprising: an inner collapsible container for containing a printing fluid, the container having an outlet for connection to the printer; an outer housing in which the container is housed; an electronic storage device configured to store data relating to the contents of the cartridge; at least one electrical contact associated with the electronic storage device; the housing having a front wall with a first aperture for the outlet, the at least one aperture being disposed at the front wall; wherein the outer housing has rigid side walls and at least one slit provided immediately adjacent corner portions of the side walls so that the corner portions can flex inwardly towards the container.

At least one locating element may be defined on a surface of at least one of the corner portions, the locating element being for engagement with a complementary element on a cartridge holder.

According to another aspect of the invention there is provided a fluid cartridge for an ink jet printer, the cartridge comprising: an inner collapsible container for containing a printing fluid, the container having an outlet for connection to the printer; an outer housing in which the container is housed; an electronic storage device configured to store data relating to the contents of the cartridge; at least one electrical contact associated with the electronic storage device and provided on a substrate; the housing having a front wall with a first aperture for the outlet, the at least one aperture being disposed at the front wall; and wherein the housing has a locking tongue with a formation for engagement in a slot or recess in the substrate.

In another aspect, the invention provides a container for storing and dispensing liquid comprising a reservoir with walls enclosing an internal space having a variable volume for storage of a liquid and a port for dispensing the liquid, wherein the reservoir is adapted to support a reduction in pressure of the internal space whereby the equilibrium pressure difference between the internal space and the surrounding atmosphere increases substantially monotonically in magnitude as liquid is dispensed, wherein the port is adapted to allow liquid to be dispensed when a withdrawal pressure at the exterior of the port is less than the equilibrium pressure of the internal space, and wherein the port is adapted to prevent air from entering the internal space from outside the reservoir as liquid is dispensed.

Suitably the container is a replaceable container for storing and dispensing ink or solvent for use with a printer, i.e. a printing device or apparatus.

Suitably, the printer is an ink jet printer, particularly a continuous ink jet printer. The liquid may be an ink such as a dye-based ink or a pigment-based ink, or may be a solvent suitable for use as a diluent for the ink or for cleaning or flushing the liquid conveying lines of the printer.

The reservoir of the container is adapted to support a reduction in the equilibrium pressure of the internal space such that the magnitude of the pressure difference between the internal space and the surrounding atmosphere increases substantially monotonically as the variable volume of the internal space reduces as liquid is dispensed. The reduction is a reduction in pressure as compared to surrounding atmospheric pressure. In other words, the pressure in the internal space will typically start out, when the reservoir is first filled, at atmospheric pressure. As liquid is dispensed, the pressure of the inner space of the reservoir, and of the liquid therein, will have an equilibrium value which is less than atmospheric pressure, and this equilibrium value of the pressure in the internal space will continue to become smaller as more liquid is dispensed from the inner space. Liquids are incompressible, and so when liquid generally is removed from a closed internal space, the removed liquid must be either replaced by another fluid, typically gas, usually air, or the volume of the closed space must decrease to compensate for the lost liquid. If the reservoir enclosing the internal space is rigid, then gas must enter to allow liquid to be removed. If the reservoir is permanently or plastically deformable, such as the reservoir of a toothpaste tube, then the removal of liquid leads to the atmospheric pressure outside the tube squeezing the reservoir such that the internal space is reduced to compensate for the lost liquid. For the present invention, the reservoir of the container is such that it will deform to allow the internal space to be reduced to compensate for the loss of liquid dispensed through the port, but the deformation of the reservoir leads to a reduction in the pressure inside the internal space. If it is desired to extract or dispense more liquid from the internal space of the reservoir, through the port, it will be necessary to reduce the pressure at the exterior of the port to a value that is less than the equilibrium pressure in the internal space of the reservoir whereby liquid may flow out through the port. This in turn leads to further decrease in the internal volume of the reservoir, and an even lower pressure inside the internal space.

The walls of the reservoir are such that they able to support the pressure differential between the internal space and the surrounding atmosphere.

As liquid is dispensed from the internal space of the reservoir through the port, the pressure to be applied at the port to suck the liquid out through the port will decrease substantially monotonically as the reservoir is emptied.

For any particular container according to the invention, there will be a relationship between the minimum withdrawal pressure required to allow dispensing and the volume of the internal space. By means of this relationship, and by measuring the minimum withdrawal pressure required to dispense liquid through the port of the cartridge, it is possible to derive the volume remaining in the internal space of the reservoir, and hence to deduce the volume of liquid remaining in the container.

Hence, another aspect of the invention provides a method for measuring the volume of liquid in a container comprising the steps of:

i) providing a container for storing and dispensing liquid comprising a reservoir with walls enclosing an internal space having a variable volume for storage of a liquid and a port for dispensing the liquid,
ii) connecting the port to an inlet of a pumping means of the printer by a fluid-tight connection,
iii) operating the pumping means to form a withdrawal pressure at the exterior of the port,
iv) measuring the minimum withdrawal pressure required to allow dispensing of liquid through the port, and
v) determining the volume of liquid from the measured minimum withdrawal pressure.

Typically, the volume of liquid is determined from a known relationship between the minimum withdrawal pressure required to allow dispensing and the volume of the internal space.

This method is particularly useful for measuring the volume of liquid in a replaceable container attached to a printer such as an ink jet printer or a continuous ink jet printer.

Hence another aspect of the invention provides an ink jet printer having a container removably attached thereto and a pumping means, the container comprising a volume of liquid substantially filling the volume of the internal space of the reservoir of the container and having the port of the reservoir connected to an inlet of the pumping means of the ink jet printer by a fluid-tight connection, wherein the pumping means is adapted to form a withdrawal pressure at the exterior of the port of the reservoir, the ink jet printer further comprising a pressure measurement means for measuring the withdrawal pressure and a control means for determining the volume of liquid in the internal space of the reservoir of the container from a minimum liquid withdrawal pressure measured by the pressure measurement means.

The ink jet printer is suitably a continuous ink jet printer.

The invention is based upon the following physical principles. If no force acts normal to a tensioned surface, then the surface will remain flat. If the pressure on one side of the surface differs from pressure on the other side, the pressure difference times surface area results in a normal force. In order for equilibrium to be established, the tension forces in the tensioned surface must cancel the force due to pressure, and this leads to the surface becoming curved. Probably the most well-known application of this principle is a child's balloon, where the gas pressure inside the balloon is greater than the atmospheric pressure outside the balloon, with the pressure difference compensated by the tension in the curved elastic surface of the balloon. The pressure is generally greater on the concave side of a tensioned surface when the initial, untensioned surface is flat. However, if the initial, untensioned surface is concave initially, when the pressure on each side of the surface is the same, then reducing the pressure on the concave side of the surface can lead to it remaining concave, but with a greater radius of curvature, as tension is established in the surface to provide equilibrium.

Suitably, the reservoir of the container comprises a rigid framework and one or more elastically deformable sections. For instance, a rubber membrane, such as a balloon, stretched over a rigid skeleton in the form of a rectangular parallelepiped could be a suitable reservoir, with a valved opening in the balloon forming the port. As liquid is removed from the reservoir through the valved port, the rubber membrane would become convex towards the internal space leading to an equilibrium pressure difference between the internal space and the outside of the reservoir (the outside of the reservoir will be at atmospheric pressure, which remains relatively constant). If the atmospheric pressure is P, and the pressure in the internal space is PI, where PI<P then the pressure required to withdraw liquid through the valved port will be Pw, where PW<PI. This pressure difference (pressure reduction) will increase substantially monotonically in magnitude as more liquid is removed from the reservoir. By increasing substantially monotonically, it is meant that a decrease in the volume of liquid generally leads to an increased magnitude of pressure difference, although minor deviations from this behaviour (say of a decrease of no more than 10% in pressure difference before decrease is continued, preferably no more than 5%, more preferably no more than 1%) may be tolerated provided that the overall trend is an increase in magnitude of pressure difference as volume of liquid decreases.

By rigid it is meant that the framework does not deform substantially, when the pressure difference between the inner space of the reservoir and the outside is up to 50 kPa, preferably up to 70 kPa.

Preferably, the rigid framework of the reservoir is formed by edges joining the walls of the reservoir, and at least one wall is elastically deformable, such that tension can develop in the at least one deformable wall as the volume of the internal space is decreased as liquid is dispensed from it. Suitably, all of the walls of the reservoir are elastically deformable. The angle between the walls where they join at their edges confers rigidity upon these edges.

Preferably, the walls form a box-shaped reservoir comprising two opposed face walls of similar shape joined at their perimeters by edge walls having their width substantially normal to the opposed parallel faces. Suitably, the edge walls have a width which is less than 30% of the smallest width of the opposed face walls, preferably less than 20%. This allows the opposed face walls to deform smoothly towards each other as the internal space reduces as liquid is dispensed. The opposed face walls are suitably substantially mutually parallel.

Suitably, the walls are of an elastic polymer such as high density polyethylene. Any suitable elastic material may be used for the walls. In order for the reservoir to be refilled, no permanent deformation should occur in the reservoir, even when the pressure of the internal space has been reduced to 50 kPa or less, preferably 40 kPa or less, more preferably 20 kPa or less. Atmospheric pressure is about 100 kPa or 1 Bar.

The reservoir may be formed from a thermoplastic material, suitably by blow moulding. Suitably, the reservoir and port may be formed as a blow-moulded item.

The container may simply be the reservoir and port, but suitably these may be provided with a rigid cover to facilitate handling.

The relationship between the volume of the internal space of the reservoir and the withdrawal pressure PW, necessary to allow liquid to be dispensed through the port will depend upon the shape, materials, thickness, Young's modulus, etc. of the reservoir materials. The relationship could be calculated, but is preferably measured experimentally for each particular reservoir design. This can be easily achieved, for instance by the following steps:

i) provide the container with the internal space filled with a known volume of liquid and at the same pressure as the outside, atmospheric pressure,
ii) attaching the port to a dispensing conduit by means of a fluid-tight connection,
iii) withdrawing a volume of liquid through the port by means of a pump attached to the dispensing conduit,
iv) measuring the volume of liquid removed (for instance by weighing or volumetric measurement) and the corresponding pressure PW in the conduit (for instance by means of a pressure gauge such as a transducer),
v) calculating the volume of liquid remaining in the reservoir,
vi) repeating steps (iii) to (iv) to obtain the relationship between the volume of liquid remaining and the withdrawal pressure Pw.

To put the method into effect, the information concerning the relationship between the minimum withdrawal pressure required to allow dispensing and the volume of the internal space may be supplied with each container. Suitably, the containers may be made to identical manufacturing specifications, such that within manufacturing tolerances, all containers have the same relationship between the minimum withdrawal pressure required to allow dispensing and the volume of the internal space may be supplied with each container.

The use of the container is described below with reference to a continuous ink jet printer, but a similar method of use would apply to other devices.

When the container is used with a device such as a printer, it is attached to the printer, with the port of the container attached to a liquid inlet conduit by a fluid-tight connection, fluid will be drawn from the container, through the port, for instance by a top-up pump controlled by a control means for the printer. The liquid will be delivered by the pump to the ink storage tank of the printer, from where it may be directed to the print head. Typically, the control means for the printer will comprise a software program running on a microprocessor chip, controlling the operation of the printer. The minimum withdrawal pressure required to allow dispensing of liquid through the port can be measured, for instance by means of a pressure gauge or a transducer located between the top-up pump and the port of the container. The control means can then use the relationship between the measured withdrawal pressure PW and the volume of the internal space of the reservoir to calculate the volume of liquid remaining in the container. Another method of measuring the pressure, by indirect means, is to measure the power required to operate the top-up pump when it is withdrawing liquid from the reservoir, and using a known relationship between pump power input and pressure drawn by the pump to deduce or calculate the minimum withdrawal pressure PW.

The calculated value of the volume of liquid remaining in the container may be used in various ways. For instance it may be displayed on a display means, or it may be used to provide a warning signal to an operator that a refill will be needed when the calculated value of the volume falls below a certain level.

For the system to operate reliably, it is evident that it important to avoid fluid, such as air, bleeding into the internal space of the reservoir following removal of liquid. This is achieved by ensuring that the port is provided with a fluid-tight seal or valve which does not allow fluid to enter the internal space from the outside. Suitably, the port is adapted to mate with a connector on a device with which the container is to be used so as to form a fluid tight connection. Any suitable fluid tight connection arrangement may be used, such as is well known in the art for hydraulic linkages.

One suitable arrangement for controlling the dispensing of liquid, without air entering the inner space of the reservoir is for the port to be provided with a self-sealing septum, pierced by a hollow tube or needle when the replacement cartridge is in use. Liquid may be drawn through the hollow tube, by a pump to which the tube is connected by a fluid-tight connection. When the container is removed from the device with which it is being used, such as a printer, the hole in the septum seals itself, preventing the ingress of fluid such as air into the internal space of the reservoir. Suitable material for such a septum is silicone rubber or butyl rubber, preferably provided with a PTFE lining Another suitable arrangement for the port is to provide it with a valve adapted to remain closed to flow of fluid when the pressure on the reservoir side of the valve is lower that the pressure on the outside of the valve, and adapted to open to flow of fluid when the pressure on the outside of the valve is lower than the pressure on the inside of the valve. A suitable valve would be a flap, hinge or diaphragm valve. When the container is in use, the outer side of the valve would be in fluid-tight connection with a pump via a conduit, such that liquid would be dispensed through the valve when the pressure in the conduit is reduced by the pump to a value less than the pressure inside the internal space of the reservoir. When the container is removed from fluid-tight connection with the pump, the pressure at the outside of the valve will increase to atmospheric pressure, closing the valve to fluid flow and preventing the ingress of air into the internal space of the reservoir.

The system will still operate if small quantities of gas, such as air, are present in the internal space of the reservoir, but these should be less than 10% by volume of the initial volume of liquid, preferably less than 5%, more preferably less than 1%. This is what is meant by the statement that the internal space of the reservoir is substantially filled with liquid. The operation of the method should be such that the pressure in the internal space of the reservoir does not fall below the equilibrium vapour pressure of the liquid at the temperature of operation. This would lead to the formation of vapour in the internal space of the reservoir and the removal of liquid from the internal space would result in no further reduction in the pressure of the internal space, which would remain at the equilibrium vapour pressure of the liquid at that temperature.

Preferably, the container comprises an electronic data storage means storing the relationship between the minimum withdrawal pressure required to allow dispensing and the volume of the internal space for the container, whereby the relationship can be read from the electronic data storage means.

Suitably, the control means for the device using the container, such as a printer, will be adapted to read the data on the electronic data storage means of the container. For instance, when the container is in place on such a device, electrical contacts on the electronic data storage means may be in placed in physical contact with electrical leads attached to the control means, whereby the control means can access and read the data on the electronic data storage means.

The measured volume of liquid, as calculated, for instance by the control means, may be written to the electronic data storage means whereby the volume of liquid remaining in the container can be monitored by reading the electronic data storage means. This gives the advantage that if the container is detached from a printer when still containing liquid, the amount of liquid remaining in the container may be read directly from the electronic data storage means, without the need to measure the minimum withdrawal pressure required to dispense liquid through the port of the reservoir. Other information may also be stored on the electronic data storage means, for instance the number of times that the container has been refilled. Such data may be used to retire the container once a maximum number of refills has been exceeded. To prevent illicit refilling of retired containers, such data may be stored in a manner such that it cannot be overwritten or cleared once the container has been retired (for instance by using memory which is writable only once).

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION

Figure 1:
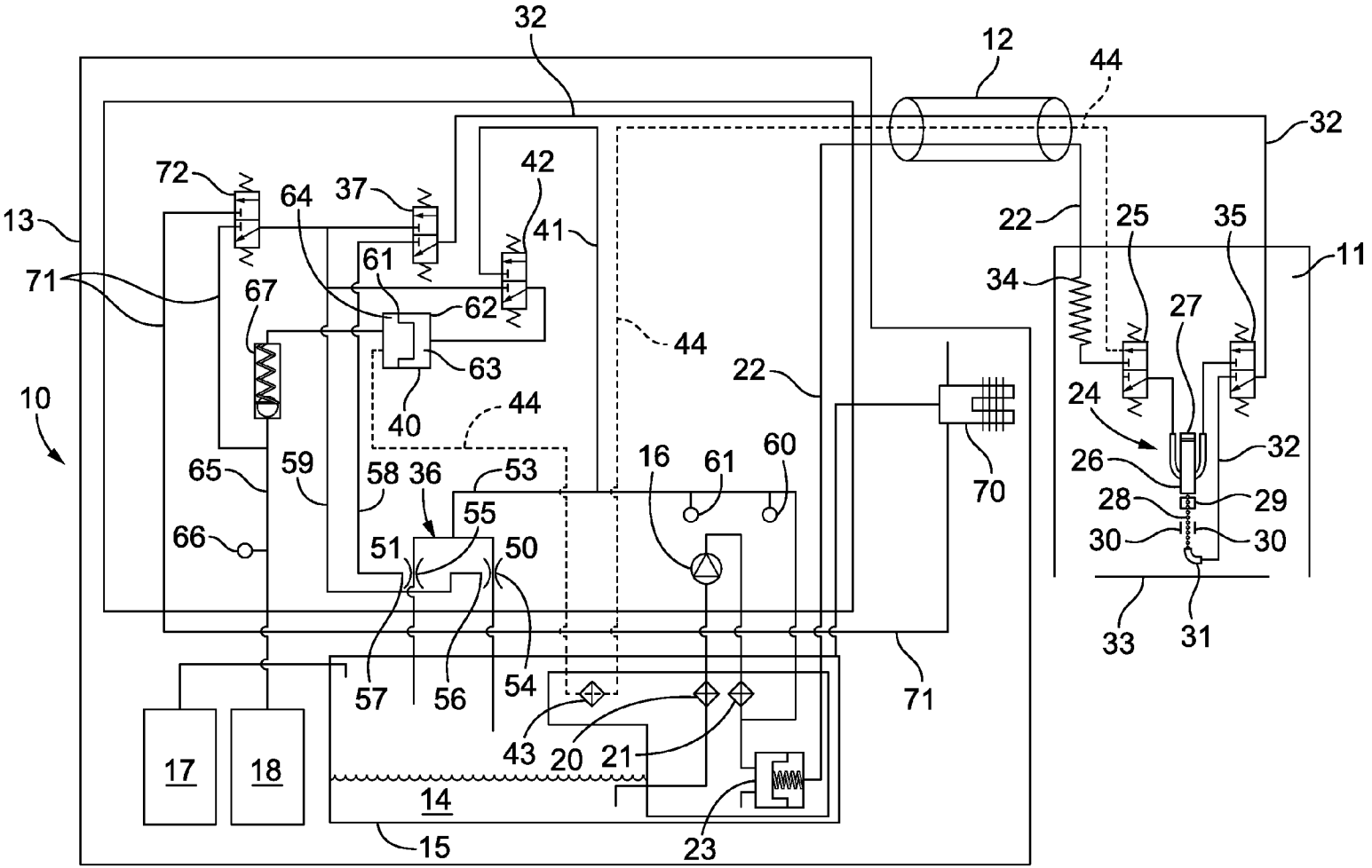
FIG. 1 is a schematic representation of an embodiment of a continuous ink jet printer of the present invention.

The invention is described with reference to the drawings in which like elements are referred to by like numerals. The relationship and functioning of the various elements of this invention are better understood by the following detailed description. However, the embodiments of this invention as described below are by way of example only, and the invention is not limited to the embodiments illustrated in the drawings.

The present disclosure provides a fluid cartridge for an ink jet printer. The cartridge includes an inner reservoir and an outer housing. The structure of the reservoir provides, as liquid is dispensed, a reduction in pressure of the printing fluid in the inner reservoir whereby the equilibrium pressure difference between the internal space and the surrounding atmosphere increases substantially monotonically in magnitude.

Referring now to the ink jet printer shown in FIG. 1 of the drawings, ink is delivered under pressure from an ink supply system 10 to a print head 11 and back via flexible tubes which are bundled together with other fluid tubes and electrical wires (not shown) into what is referred to in the art as an "umbilical" conduit 12. The ink supply system 10 is located in a cabinet 13 which is typically table mounted and the print head 11 is disposed outside of the cabinet. In operation, ink is drawn from a reservoir of ink 14 in a mixer tank 15 by a system pump 16, the tank 15 being topped up as necessary with ink and make-up solvent from replaceable ink and solvent cartridges 17, 18. Ink is transferred under pressure from the ink cartridge 17 to the mixer tank 15 as required and solvent is drawn from the solvent cartridge 18 by suction pressure as will be described.

It will be understood from the description that follows that the ink supply system 10 and the print head 11 include a number of flow control valves which are of the same general type: a dual coil solenoid-operated two-way, two port flow control valve. The operation of each of the valves is governed by a control system (not shown in the FIGS.) that also controls operation of the pumps.

Ink drawn from the tank 15 is filtered first by a coarse filter 20 upstream of the system pump 16 and then by a relatively fine main ink filter 21 downstream of the pump 16 before it is delivered to an ink feed line 22 to the print head 11. A fluid damper 23 of conventional configuration and disposed upstream of the main filter 21 removes pressure pulsations caused by the operation of the system pump 16.

At the print head the ink from the feed line 22 is supplied to a drop generator 24 via a first flow control valve 25. The drop generator 24 comprises a nozzle 26 from which the pressurized ink is discharged and a piezoelectric oscillator 27 which creates pressure perturbations in the ink flow at a predetermined frequency and amplitude so as break up the ink stream into drops 28 of a regular size and spacing. The break up point is downstream of the nozzle 26 and coincides with a charge electrode 29 where a predetermined charge is applied to each drop 28. This charge determines the degree of deflection of the drop 28 as it passes a pair of deflection plates 30 between which a substantially constant electric field is maintained. Uncharged drops pass substantially undeflected to a gutter 31 from where they are recycled to the ink supply system 10 via return line 32. Charged drops are projected towards a substrate 33 that moves past the print head 11. The position at which each drop 28 impinges on the substrate 33 is determined by the amount of deflection of the drop and the speed of movement of the substrate. For example, if the substrate moves in a horizontal direction, the deflection of the drop determines its vertical position in the stroke of the character matrix.

To ensure effective operation of the drop generator 24 the temperature of the ink entering the print head 11 is maintained at a desired level by a heater 34 before it passes to the first control valve 25. In instances where the printer is started up from rest it is desirable to allow ink to bleed through the nozzle 26 without being projected toward the gutter 31 or substrate 33. The passage of the ink into the return line 32, whether it is the bleed flow or recycled unused ink captured by the gutter 31, is controlled by a second flow control valve 35. The returning ink is drawn back to the mixer tank 15 by a jet pump arrangement 36 and a third flow control valve 37 in the ink supply system 10.

As ink flows through the system and comes into contact with air in the tank 15 and at the print head 11, a portion of its solvent content tends to evaporate. The ink supply system 10 is therefore also designed to supply make-up solvent as required so as to maintain the viscosity of the ink within a predefined range suitable for use. Such solvent, provided from the cartridge 18, is also used to flush the print head 11 at appropriate times to keep it clear of blockages. The flush solvent is drawn through the system 10 by a flush pump valve 40 that is driven by a flow of ink in a branch conduit 41 under the control of a fourth flow control valve 42 as will be described below. The flush solvent is pumped out via a filter 43 through a flush line 44 (represented in dotted line in FIG. 1) that extends from the supply system 10 through the umbilical conduit 12 to the first flow control valve 25 in the print head 11. After passing through the nozzle 26 and into the gutter 31 the solvent is drawn into the return line 32 via the second control valve 35 and to the third control valve 37. The returning solvent flows under suction pressure from the jet pump arrangement 36.

The jet pump arrangement 36 comprises a pair of parallel venturi pumps 50, 51 that are supplied by pressurized ink from a branch line 53 from the outlet of the main filter 21. The pumps are of known configuration and make use of the Bernoulli Principle whereby fluid flowing through a restriction in a conduit increases to a high velocity jet at the restriction and creates a low pressure area. If a side port is provided at the restriction this low pressure can be used to draw in and entrain a second fluid in a conduit connected to the side port. In this instance, the pressurized ink flows through a pair of conduits 54, 55 and back to the mixer tank 15, each conduit 54, 55 having a side port 56, 57 at the venturi restriction. The increase in flow velocity of the ink creates a suction pressure at the side port 56, 57 and this serves to draw returning ink and/or solvent through lines 58, 59 when the third flow control valve 37 is open. The flow control valve 37 is operated such that the flow of returning ink/solvent to each venturi pump 50, 51 can be separately controlled. More specifically, the control system determines whether to allow flow through one or both venturi pumps 50, 51 depending on the temperature of the ink determined by a temperature sensor 60 in the branch line 53. If the ink has a relatively low temperature it will have a relatively high viscosity and therefore greater pumping power is required to draw ink back from the gutter 31 in which case both pumps 50, 51 should be operated. In the event that the ink has a relatively high temperature it will have a relatively low viscosity in which case the only one pump 50 is required to generate sufficient suction. Indeed operation of both the pumps should be avoided in the latter circumstance, as there would be a risk of air getting into the supply system, which serves to cause excess evaporation of the solvent, and therefore increased consumption of make-up solvent.

The branch line 53 is connected to line 41 that conveys ink to the flush pump valve 40 via the fourth flow control valve 42. When the control valve 42 is appropriately operated by the control system to effect flushing of the print head 11 it allows the flush pump valve 40 to be pressurized by the ink from line 41. The valve 40 is a rolling diaphragm type in which a resilient "top-hat" diaphragm 61 divides a valve housing 62 into first and second variable volume chambers 63, 64. Ink is supplied under pressure to the first chamber 63 and make up solvent is delivered from the cartridge 18 through a solvent supply line 65 to the second chamber 64 via a pressure transducer 66 and a non-return valve 67. The higher pressure of the ink entering the first chamber 63 relative to the solvent serves to deflect the diaphragm 61 from its normal position as shown in FIG. 1, to a position where the volume of the first chamber 63 has increased at the expense of the volume of the second chamber 64 and solvent is forced out of the second chamber 64 and towards the print head 11 via the flush line 44. It is to be appreciated that other flush pump designs may be used to achieve the same operation.

In use, the atmosphere above the mixer tank 15 soon becomes saturated with solvent and this is drawn into a condenser unit 70 where it is condensed and allowed to drain back into a solvent return line 71 via a fifth control valve 72 of the ink supply system.

Figure 2:
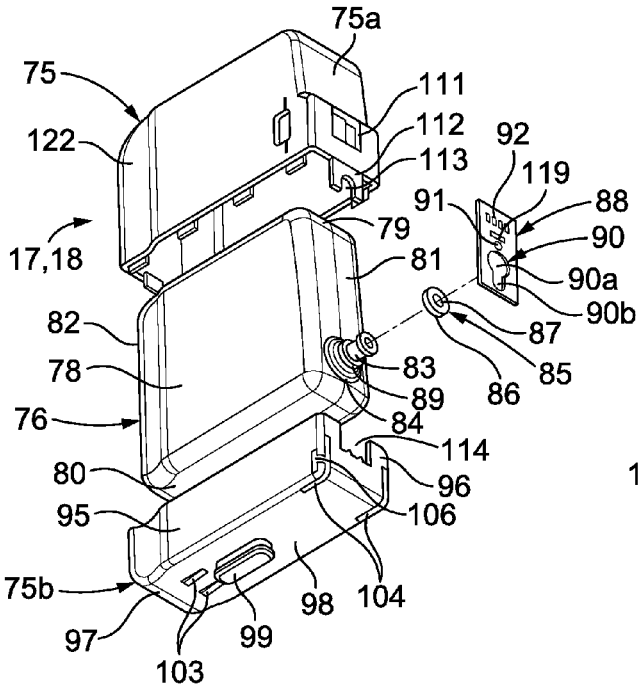
FIG. 2 is an exploded view of an embodiment of an ink cartridge in accordance with the present invention.
Figure 3A:
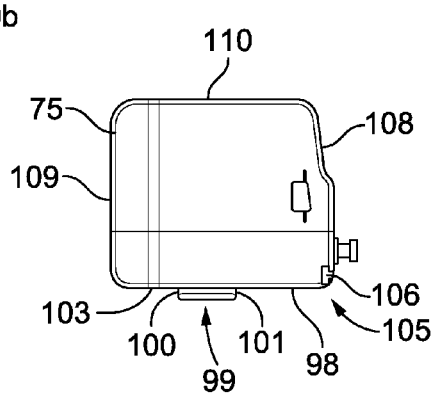
FIGS. 3A to 3C are side, underneath plan and front views of the cartridge of FIG. 2.
Figure 3B:
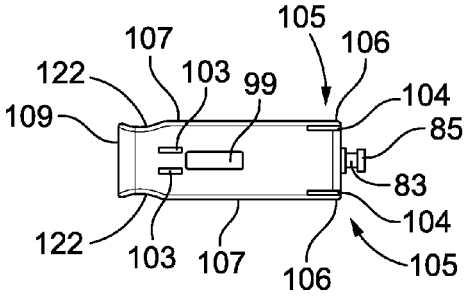
Figure 3C:
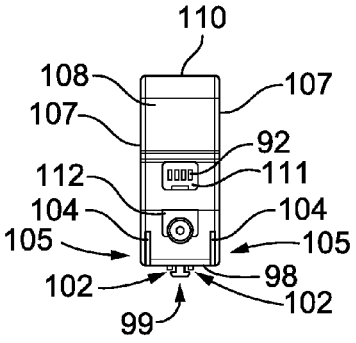
Figure 4A:
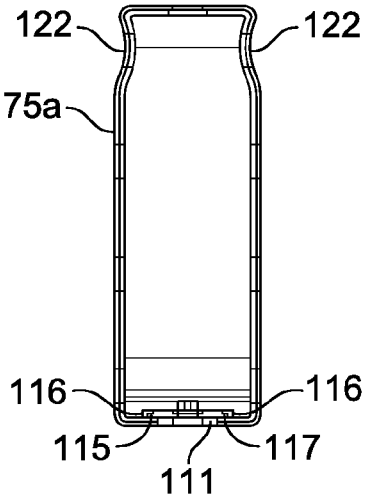
FIGS. 4A and 4B are front and sectioned side views of part of an outer housing of the cartridge of FIG. 2.
Figure 4B:
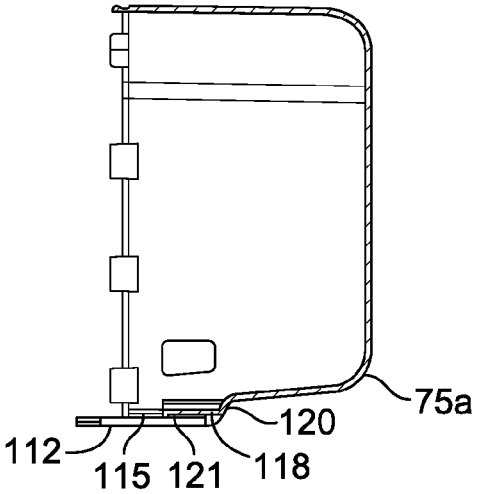
Figure 5A:
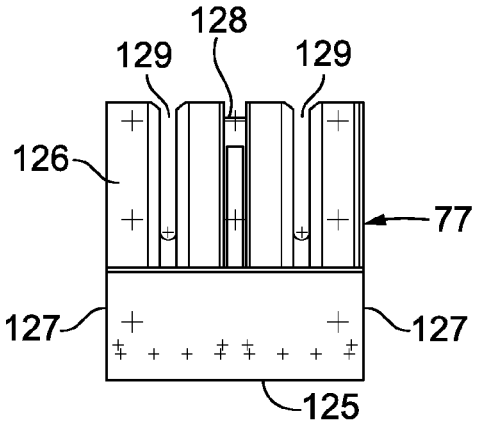
FIG. 5A is a plan view of a cartridge holder.
Figure 5B:
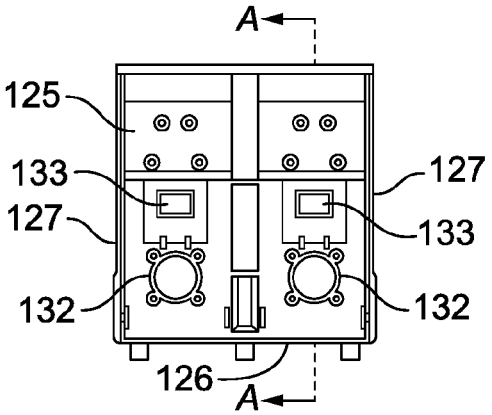
FIG. 5B is a front view of the cartridge holder of FIG. 5A.
Figure 5C:
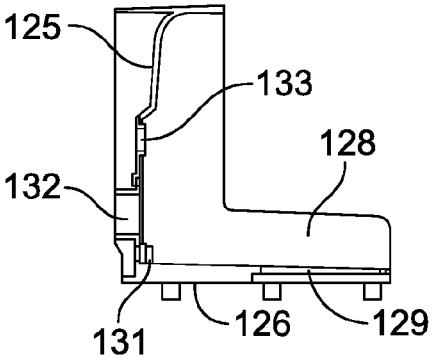
FIG. 5C is a sectioned side view of the cartridge holder, taken along line A-A of FIG. 5B.
Figure 5D:
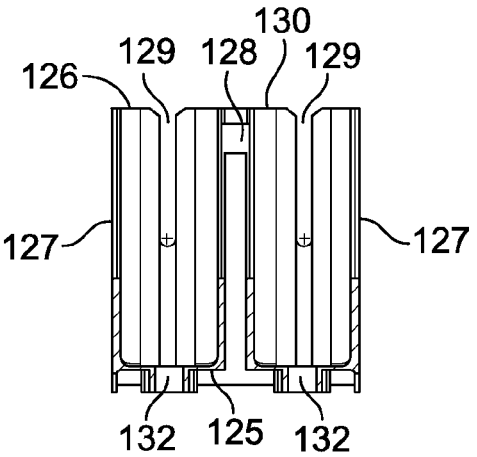
FIG. 5D is a sectioned view from above of the cartridge holder of FIG. 5A.

The two cartridges 17, 18, shown in FIGS. 2 to 4, are identical in structure and comprise a rigid outer housing 75 of a generally parallelepiped shape with an inner collapsible container 76 for storing the ink or solvent. The outer housing 75 has interconnected upper and lower portions 75*a*, 75*b* that are separable to expose the container 76.

In use, the cartridges 17, 18 are docked in a cartridge holder 77 (see FIGS. 5 and 6) that forms part of the printer, such that they are connected to the ink supply system 10. As ink or solvent is drawn from the cartridges 17, 18 by the ink supply system 10 the inner container 76 collapses within the outer housing 75, which remains undeformed.

The inner container 76 is made from a thin-walled plastics material such as, for example, HDPE and is of a similar shape to the inside of the cartridge housing 75 with a pair of opposed side walls 78, a top wall 79, a base wall 80 and front and rear walls 81, 82. An outlet port 83 extends from a raised circular area 84 at the front wall 81 and is closed by a septum seal 85. Such a seal 85 is conventional and comprises, for example, a cylindrical butyl sealing element with a protective aluminum alloy end cap 86 that has a central opening 87 so as to leave an end portion of the seal exposed for penetration by a needle connector (not shown) on the end of a supply hose of the ink supply system 10. The cartridge holder 77 is disposed adjacent to the needle connector such that as the cartridge 17, 18 is docked in the holder the seal is first brought into alignment with the needle connector and the cartridge is then pushed into engagement such that the needle penetrates the seal and fluid communication is made between the cartridge and the rest of the ink supply system. The walls of the container are thin (for example 0.35 to 1.00 mm) and flexible so as to allow it to collapse inwardly with relative ease as its fluid contents are drawn through the outlet port. However the raised circular area 84 around the outlet port 83 and the port 83 itself are of greater thickness to provide a degree of rigidity.

Figure 10:
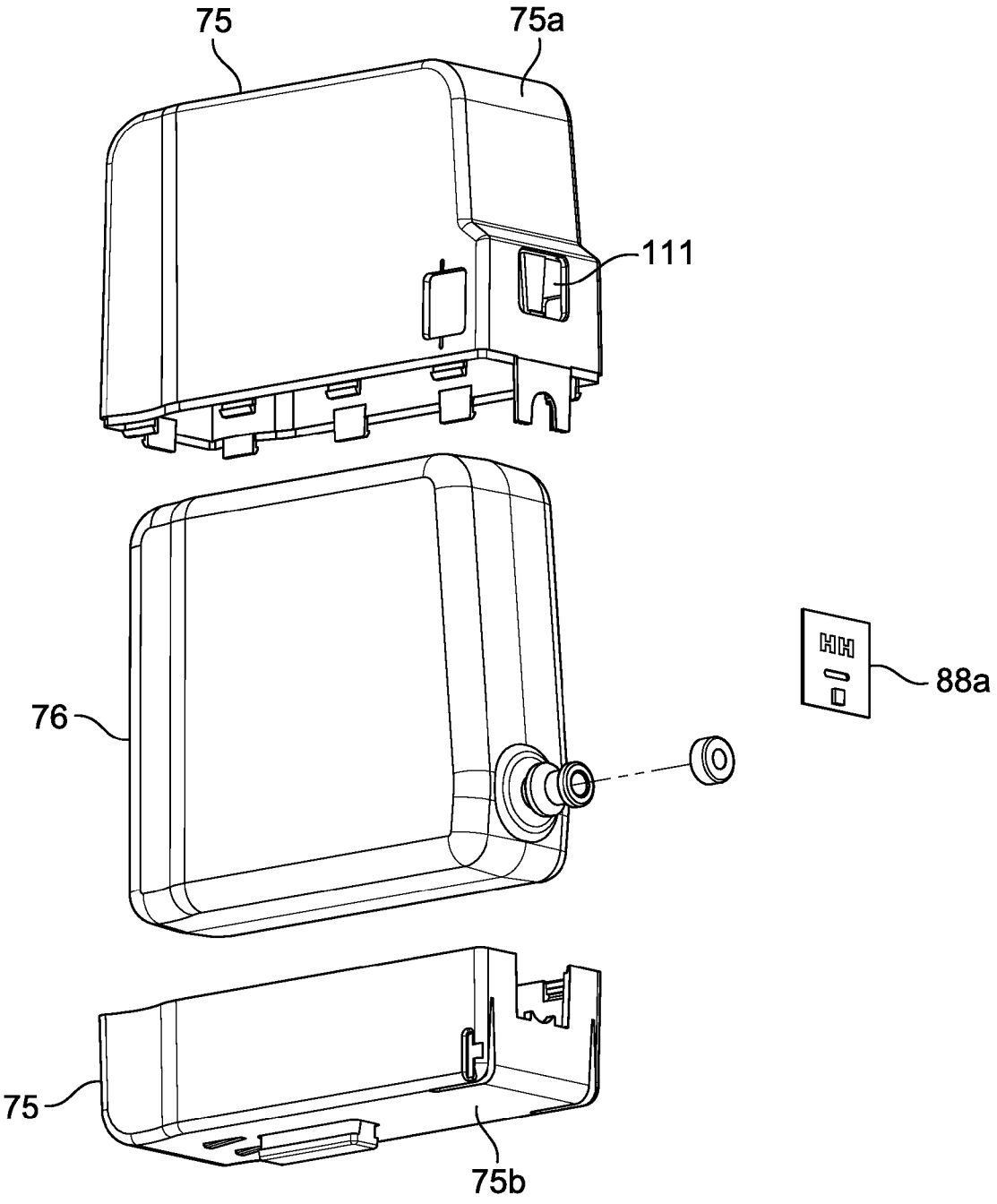
FIG. 10 is an exploded view of another embodiment of an ink cartridge in accordance with the present disclosure.

At least the ink cartridge 17 is provided with a data storage card 88 that enables identification of the contents of the cartridge. The outlet port 83 has a reduced diameter neck 89 over which the data storage card 88 is located. The card 88 is a rigid printed circuit board with a generally rectangular with an aperture 90 by which it is located over the neck 89. The shape of the aperture is configured to allow easily connection of the card 88 to the container 76, in particular it has main circular portion 90*a*, that is larger than the outer diameter of the outlet port 83 and thus allows the card 88 to be placed over the end of the port and a narrower slot 90*b* extending radially from one edge of the main portion 90*a*. Once the card 88 has been located over the port 83 it is moved laterally thereof to allow the slot 90*b* to slide over the neck 89 in a snug fit. In this position the card 88 is supported on the relatively flat and rigid raised circular area 84 around the outlet port 83. The card 88 is provided with a memory chip 91 along with surface-mounted electrical contacts 92 for connection to corresponding contacts provided on the printer. When the cartridge 17, 18 is assembled the card 88 is supported between the housing 75 and the container 76 as will be described below. FIG. 10 shows an alternative card 88*a*. Card 88*a* is rectangular in shape and does not include the aperture 90 of card 88. In other respects the card 88*a* is similar to the card 88. Card 88 is provided between inner reservoir 76 and outer housing 75, with the surface-mounted electrical contacts 92 accessible through aperture 111.

The lower portion 75*b* of the cartridge housing 75 has opposed side walls 95, front and rear walls 96, 97, and a lower wall 98 on which there are defined several location or guide features that facilitate secure registration with the holder 77. The principal means of engagement with the holder 77 is provided by a key 99 that is designed to locate in a corresponding keyway slot in the holder so that the movement of the cartridge 17, 18 relative to the holder 77 is guided. The key 99 has an inverse T-shape with a narrow stem 100 and a slightly wider base web 101, the clearance between the web 101 and the surface of the lower wall 98 providing an elongate groove 102 on each side of the stem 100 for connection with part of the holder 77. Immediately behind the key 99 there is a pair of shallow ramps 103 and at the corners between the front and lower walls 96, 98 there is a pair of flared slits 104 that extend along a portion of the lower and front walls. These slits 104 allow the corner portions 105 of the side walls of the housing to flex laterally inwards relative to the rest of the housing 75 when suitable pressure is applied. Finally, there is a small locating recess 106 provided on each corner portion 105.

The upper portion 75*a* of the cartridge housing 75 similarly includes opposed side walls 107, front and rear walls 108, 109 and an upper wall 110. When the housing portions 75*a*, 75*b* are connected together the respective side walls 95, 107 are substantially contiguous, as are the respective front 96, 108 and rear walls 97, 109. The front wall 108 has a substantially square aperture 111 disposed above a depending tab 112 with a U-shaped opening 113. In bringing the housing portions 75*a*, 75*b* together the tab 112 passes around the outlet port 83 of the inner container 76 and is received in a corresponding cut-out 114 in the front wall 96 of the housing lower portion 75*b*, the port 83 extending through the U-shaped opening 113.

When the cartridge housing portions 75*a*, 75*b* are assembled around the inner container 76, the data storage card 88 is supported in a pocket 115 (FIGS. 4A and 4B) defined on the inside surface of the front wall 108 adjacent to the tab 112. The pocket 115 is provided by a pair of spaced, elongate L-shaped formations 116 that each define a slot 117 with the inside surface of the front wall 108. Provided the card 88 is correctly located on the outlet port 83 of the inner container 76 its edges will be received in the slots 117 when the two housing portions 75*a*, 75*b* are brought together into mating engagement. The pocket 115 thus helps to ensure that the card 88 is correctly positioned relative to the housing 75 so that the contacts 92 are disposed in the correctly location for connection to the contacts on the printer. In addition to the pocket 115, the card 88 is also supported in position by a resilient locking tongue 118 that engages with a slot 119 in the card. The tongue 118 depends from a short inclined portion 120 of the front wall 108 and terminates in a protruding locking tip 121 for engagement with the slot 119 in the card 88. As the card 88 slides into the pocket 115 the tongue 118 is deflected rearwardly and rides over its rear surface until the tip 121 is aligned with the slot 119 thereby allowing the tongue 118 to flex forwards and into locking engagement with the card 88.

To allow easy manipulation of the cartridge 17, 18 when it is being docked with, or removed from, the holder 77, the side walls are each provided with an elongate, shallow arcuate recess 122 by which it can be grasped.

The cartridge holder 77 will now be described with reference to FIGS. 5A to 5D. It has a generally L-shaped appearance with perpendicular front and base walls 125, 126 joined by parallel L-shaped side walls 127 that are spaced apart so as to define between them an interior volume in which the cartridges 17, 18 can be removably received. This volume is divided into two side-by-side holder portions by a middle wall 128 that extends substantially in parallel to the side walls 127, such that each holder portion is designed to receive one cartridge. The base wall 126 has a pair of keyway slots 129, one in each holder portion, that extend approximately half way towards the front wall 125 from a rear edge 130. In use, these slots 129 are designed to receive the key 99 defined on the lower wall 98 of each cartridge housing 75. The inner surface of each side wall 127 has a small locating rib 131 adjacent to the corner with the base wall 126, the rib being for engagement in a corresponding recess 106 in the corner portion 105 of the cartridge 17, 18.

The cartridge holder 77 is located in the printer such that the front wall 125 affords an interface for the cartridges 17, 18 with the ink supply system 10. In particular, the front wall 125 has a pair of circular ports 132 that are in register with the needle connectors in the ink supply system 10 and, immediately above, a pair of square windows 133 in alignment with electrical contacts provided in the printer that are connected to the control system.

Figure 6:
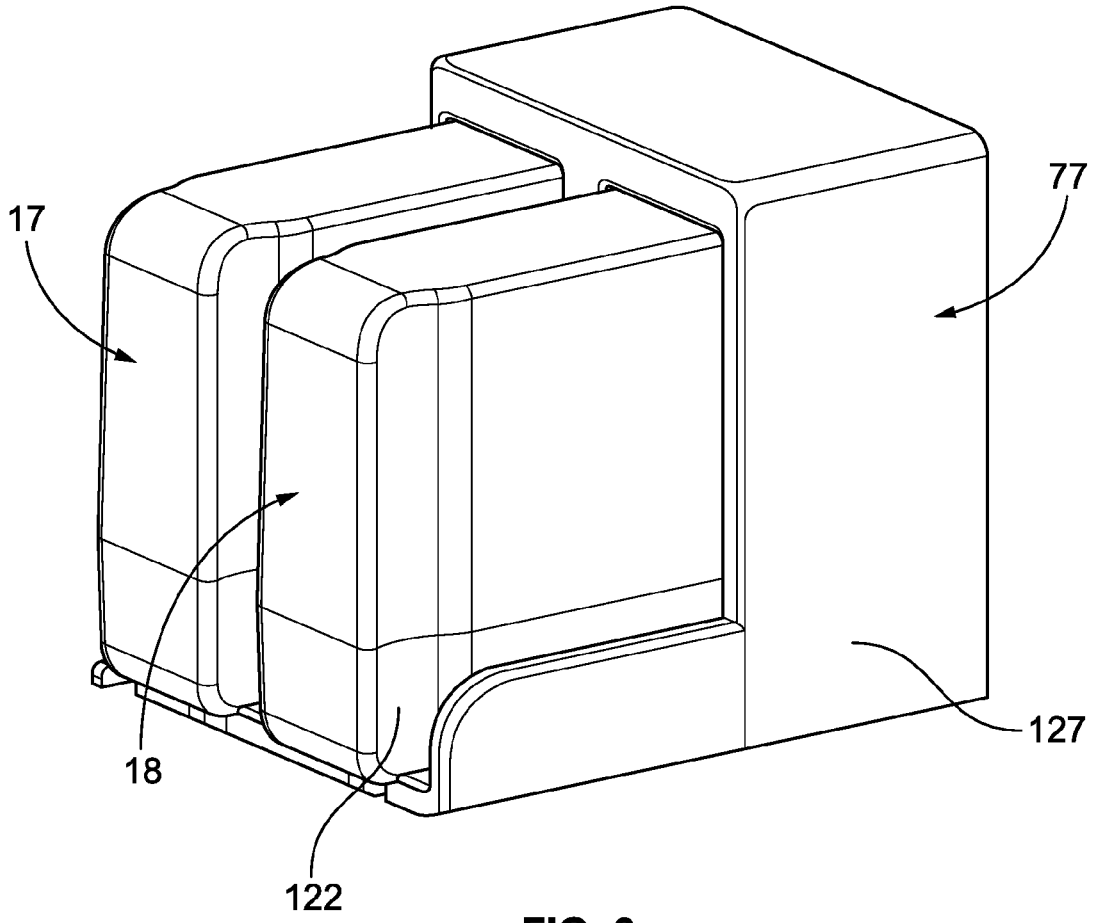
FIG. 6 is a perspective view of a pair of cartridges of FIGS. 2 to 4 engaged in the cartridge holder of FIG. 5.

The process of docking the cartridges 17, 18 with the holder 77 is a simple operation as will be appreciated by the following description and with reference to FIG. 6. The object is to ensure that cartridge 17, 18 is docked securely so that the needle connector has penetrated the seal in the outlet port 83 of the cartridge 17, 18 and the respective electrical contacts 92 on the data storage card 88 associated with the cartridge 17, 18 are in register with those on the printer side so as to allow electrical signals to be conducted between them.

Each assembled cartridge 17, 18 is offered to the corresponding holder portion by grasping it by the arcuate recess 122 and presenting the key 99 to the respective keyway slot 129 in the holder such that the edges of the base wall 126 of the holder around the slots 129 are received in the elongate grooves 102 of the key 99. The cartridge 17, 18 is then slid forward so that the outlet port 83 of the inner container 76 passes through the respective circular port 132 in the front wall 125 of the holder 77 and the square aperture 111 in the housing is brought into alignment with the window 133 of the holder 77. As the cartridge 17, 18 approaches full engagement with the holder 77, the locating ribs 131 in the holder ride over the side walls 95 of the lower portion 75*b* of the housing and initially force the corner portions 105 inwards until the ribs 131 are brought into register with the locating recesses 106 whereupon the corner portions 105 snap back into place. At more or less the same time the ramps 103 engage with the surface of the base wall 126 of the holder 77 and serve to raise the cartridge 17, 18 very slightly relative to the holder 77 such that the key 99 is brought into frictional engagement with the edges of the keyway slots 129 in the base wall 126 of the holder 77. These two actions combine to provide for a secure and definite location of the cartridge 17, 18 such that the user intuitively feels when the cartridge docked and therefore knows that the needle connector has penetrated the seal in the cartridge and that the respective electrical contacts are in abutment. However, it will be appreciated that these locating features are not imperative to the successful operation of the cartridge in the printer and that they may be omitted. Alternatively, only one of such features may be provided.

As ink or solvent is drawn from the cartridge 17, 18 the inner container 76 collapses in a reasonably predictable manner with its side walls 78 moving inwards towards an intermediate plane mid-way between the side walls and substantially parallel thereto. The relatively thick rigid wall of the raised circular area 84 ensures that there is no significant tendency for it to collapse inwardly and thus apply a force on the port 83 that would tend to move it relative to the housing 75, which is undesirable. It will be appreciated that the combination of the rigidity of the container 76 in this area and the pocket 115 defined on the inside of the housing 75 ensures that the card 88 is maintained in position whilst the container 76 collapses so that the electrical contacts remain in abutment at all times.

It will be appreciated that numerous modifications to the above described embodiment may be made without departing from the scope of the invention as defined in the appended claims. In particular, the exact shape, size and arrangement of the locating features between the holder and the cartridge may vary. For example, any suitable connection between the holder and the cartridge may be provided that ensures the cartridge is guided into effective engagement with the holder and therefore effective connection to the printer. The male key 99 on the cartridge and the female keyway slots 129 on the holder 77 may be reversed and any other suitable male and female connection may be provided. Furthermore, the data storage memory chip 91 may be any suitable electronic storage device, may be supported on any suitable substrate and may be connected to suitable electrical contacts (or contact) in any convenient manner, providing those contacts are accessible for connection to the printer when the cartridge is docked in the housing. For example, access to the electrical contacts 92 may be provided by a substrate applied to the front wall 108 of the housing 75. The contacts 92 are connected to the data storage device 91 that may be supported on the substrate or located elsewhere such as in the housing. The substrate may take any suitable form such as a rigid card or a flexible adhesive film or label.

Figure 7:
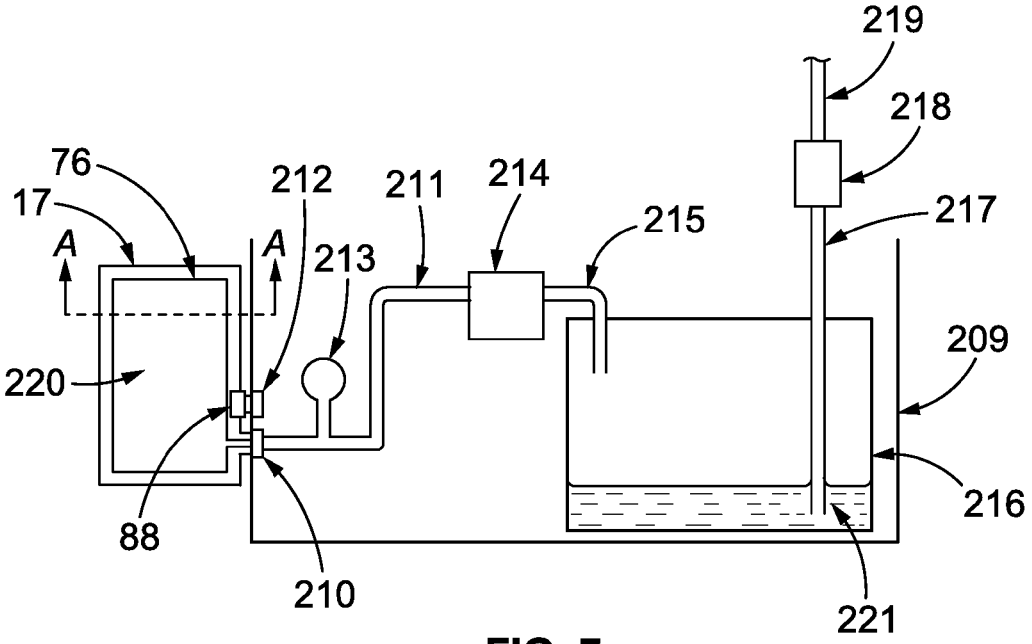
FIG. 7 is a schematic representation of part of a continuous ink jet printer fitted with a replacement cartridge which is a container according to the present invention.

Referring to FIG. 7, a cartridge 17 is attached to a printer 209 with the septum seal 85 on the port 83 attached to a fluid-tight connector 210 on the printer 209. Ink 220 fills the internal space of the reservoir 76. A hollow tube (not shown) pierces the septum seal 85 to allow fluid connection between the internal space of the reservoir 76 and a dispensing conduit 211. The electronic storage device 88 is in electrical contact with a contact pad 212 on the printer 209 by means of the electrical contacts 92. The contact pad 212 is in electrical communication with the control system (not shown) of the printer 209. A pressure gauge 213 is also present in fluid connection with the delivery conduit, as is a pump 214. The pump outlet conduit 215 feeds into the ink tank 216 containing ink 221 and a tank emptying conduit 217 is connected to a print head pump 218 whose outlet is connected to a print head delivery conduit 219.

In use, the pump 214 reduces the pressure in the delivery conduit 211 until the pressure in the delivery conduit 211 is lower than the pressure in the internal space of the reservoir 76. This leads to the liquid 220 being dispensed from the reservoir 76, through the delivery conduit 211, through the pump 214 and via the outlet conduit 215 to join the ink 221 in the tank 216. The pressure gauge 213 measures the minimum withdrawal pressure in the delivery conduit 211 required for ink 220 to be dispensed and sends this measurement to the control system (not shown) of the printer 209. From the electronic storage device 88, data concerning the relationship between the minimum withdrawal pressure required to allow dispensing and the volume of the internal space 220 is read by the control system (not shown) via the contact pad 212 and the electrical contacts 8*a* on the electronic storage device 88.

The control system uses the minimum withdrawal pressure as measured by the pressure gauge 213 and the relationship read from the electronic storage device 88 to calculate and display the volume of ink 220 remaining in the internal space of the reservoir 76 on a display means (not shown).

Figure 8A:
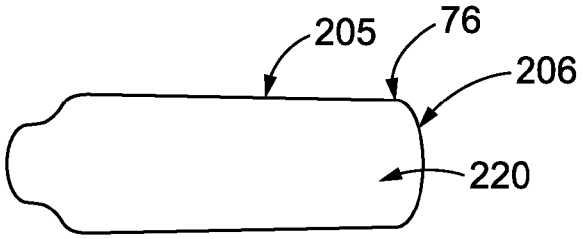
FIGS. 8A and 8B are cross sectional views through the reservoir of a replacement cartridge along the section A-A shown in FIG. 1, with FIG. 8A showing the reservoir when full of liquid and FIG. 8B the reservoir partly full of liquid.
Figure 8B:
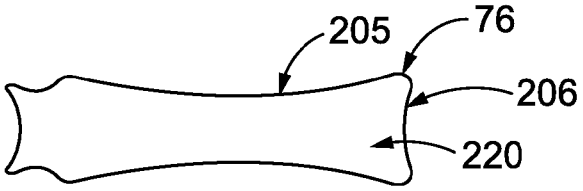

Referring to FIGS. 8A and 8B, these show cross sectional views though the reservoir 76 along the section A-A shown in FIG. 7. FIG. 8A shows the reservoir's cross section when the reservoir 76 is full of ink 220 and the pressure in the internal space of the reservoir 76 is the same as the surrounding atmospheric pressure. In FIG. 8B, the pressure in the internal space of the reservoir has been reduced by removal of ink from the reservoir. To provide equilibrium, the face walls 205 and edge walls 206 have become concave towards the outside of the reservoir and are under tension, with the force arising from the tension in the curved walls balancing the pressure difference between the internal space of the reservoir and the outside of the reservoir (at atmospheric pressure).

Figure 9:
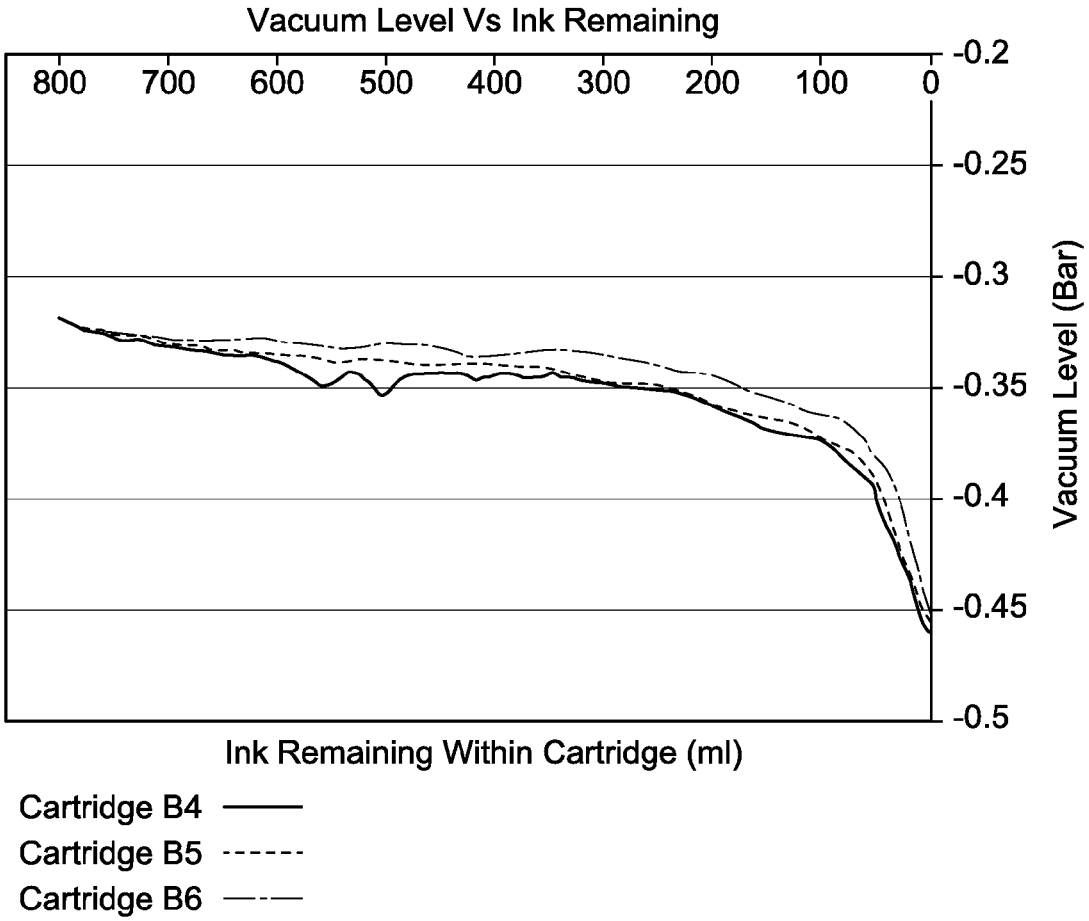
FIG. 9 is a graph showing the relationship between the minimum pressure required for dispensing, measured at the exterior of the dispensing port, and the volume of ink remaining in the internal space of the reservoir of the example replacement cartridge according to the invention.

The graphs of FIG. 9 illustrate the relationship between the internal pressure and the volume of liquid in cartridges of the kind described above. The minimum pressure is expressed as vacuum level in Bar, so a vacuum level of −0.4, for instance, corresponds to a pressure of 0.4 Bar less than the ambient pressure of 1 Bar, corresponding to about 0.6 Bar at the port and hence also in the inner space. Graphs are shown for three different cartridges, B4, B5 and B6, manufactured to the same specifications, as detailed above.

It can be seen that the reduction in pressure as volume decreases (the slope of the curves) is steeper when the cartridge is nearly empty. It can also be seen that the pressure decreases substantially monotonically as the volume remaining decreases. Cartridge B4 shows small pressure increases at some volumes, but the overall trend is for a monotonic decrease in pressure corresponding to a monotonic increase in the magnitude of the pressure reduction from ambient pressure.

It will be appreciated that numerous modifications could be made to the embodiment detailed above without departing from the scope of the invention as detailed in the claims. For instance, the liquid in the replacement cartridge could be solvent rather than ink, or a valve arrangement could be used rather than a septum seal. For instance, the data concerning the relationship between the minimum withdrawal pressure required to allow dispensing and the volume of the internal space 20 could be stored on the control system rather than read from an electronic storage device forming part of the replacement cartridge.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

What is claimed is:

1. A fluid cartridge for an inkjet printer, the cartridge comprising:

an inner reservoir containing a printing fluid, the reservoir comprising walls enclosing an internal space having a variable volume for storage of the printing fluid and a port for dispensing the printing liquid, wherein the reservoir comprises a rigid framework and one or more elastically deformable sections, an outlet for connection to the printer;

an outer housing in which the reservoir is housed;

an electronic storage device configured to store data relating to the contents of the cartridge; and at least one electrical contact associated with the electronic storage device and provided on a substrate, wherein the substrate is fixed relative to the outlet by a pocket defined on the inside of the housing and the pocket comprises at least one locking element having slots for supporting edges of the substrate;

wherein the rigid framework and one or more elastically deformable sections of the reservoir provide a reduction in pressure of the internal space whereby the equilibrium pressure difference between the internal space and the surrounding atmosphere increases substantially monotonically in magnitude as liquid is dispensed, wherein the port is adapted to allow liquid to be dispensed when a withdrawal pressure at the exterior of the port is less than the equilibrium pressure of the internal space, and wherein the port is adapted to prevent air from entering the internal space from outside the reservoir as liquid is dispensed, wherein the container is for storing and dispensing ink or solvent for use with a continuous inkjet printer.

2. A fluid cartridge according to claim 1 wherein the rigid framework is formed by edges joining the walls and at least one wall is elastically deformable.

3. A fluid cartridge according to claim 1 wherein the walls form a box-shaped reservoir comprising two opposed face walls of similar shape joined at their perimeters by edge walls having their width substantially normal to the opposed parallel faces.

4. A fluid cartridge according to claim 1 wherein the port is provided with a self-sealing septum.

5. A fluid cartridge according to claim 1 wherein the outer housing comprises a rigid cover.

6. A fluid cartridge according to claim 1 where no permanent deformation occurs in the reservoir when the pressure of the internal space is reduced to 40 kPa or less.

7. A fluid cartridge according to claim 1 wherein the outer housing comprises a first aperture for the outlet and a second aperture that provides access to the at least one electrical contact.

8. A fluid cartridge according to claim 7 wherein the substrate is disposed between the outer housing and the inner reservoir.

9. A fluid cartridge according to claim 1 wherein the printing fluid comprises organic solvent.

10. A fluid cartridge according to claim1 wherein the outlet comprises a rigid conduit extending from a wall of the container.

11. A fluid cartridge according to claim 1 wherein the walls of the container are between 0.35 mm to 1.00 mm thick.

12. A fluid cartridge according to claim 1 wherein the housing comprises side walls, each side wall provided with an elongate arcuate recess by which the housing can be grasped.

13. A fluid cartridge according to claim 1 wherein the container has a rigid supporting surface adjacent to the substrate.

14. A fluid cartridge according to claim 1, wherein the housing has a locking element for locking engagement with the substrate.

15. A fluid cartridge according to claim 14, wherein the locking element is a tongue with a tip for engagement in a slot or recess in the substrate.

16. A fluid cartridge according to claim 1 wherein the housing comprises rigid side walls and at least one slit provided immediately adjacent corner portions of the side walls so that the corner portions can flex inwardly towards the container.

17. A fluid cartridge according to claim 16, wherein at least one locating element is defined on a surface of at least one of the corner portions, the locating element being for engagement with a complementary element on a cartridge holder.

18. A fluid cartridge according to claim 1 wherein the housing comprises a guide feature extending from a surface of the housing for engaging a slot on a cartridge holder to guide movement of the cartridge relative to the cartridge holder.

19. A fluid cartridge according to claim 18, wherein the guide feature is T-shaped.

20. A fluid cartridge according to claim 18, further comprising a ramp adjacent the guide feature.

* * * * *